US006923618B1

(12) United States Patent
Hudgens

(10) Patent No.: US 6,923,618 B1
(45) Date of Patent: Aug. 2, 2005

(54) ROTARY MOTOR

(76) Inventor: William Hudgens, 43 Sunset Dr., Englewood, CO (US) 80110

( * ) Notice: Subject to any disclaimer, the term of this patent is extended or adjusted under 35 U.S.C. 154(b) by 0 days.

(21) Appl. No.: 10/673,069

(22) Filed: Sep. 26, 2003

(51) Int. Cl.[7] ..... F04D 17/00
(52) U.S. Cl. ..... 415/141; 415/174.2; 415/203
(58) Field of Search ..... 415/92, 141, 173.1, 415/173.3, 174.2, 203, 208.1, 208.2, 208.5, 415/211.1, 224, 228, 227

(56) References Cited

U.S. PATENT DOCUMENTS

| | | | | |
|---|---|---|---|---|
| 243,744 | A | 7/1881 | Wilson | |
| 516,729 | A | 3/1894 | Byrd | |
| 640,345 | A * | 1/1900 | Wilberforce | 415/211.1 |
| 763,525 | A * | 6/1904 | van Beresteyn | 418/127 |
| 865,164 | A | 9/1907 | Corthesy | |
| 909,774 | A | 1/1909 | Flora | |
| 1,149,523 | A | 8/1915 | Jerman | |
| 1,346,221 | A | 7/1920 | Liedtke | |
| 1,929,496 | A | 10/1933 | Jacuzzi | |
| 2,684,035 | A * | 7/1954 | Kemp | 415/141 |
| 2,843,049 | A * | 7/1958 | Sherwood | 415/141 |
| 2,875,988 | A | 3/1959 | Wysong | |
| 2,960,316 | A | 11/1960 | McKellar | |
| 3,734,638 | A * | 5/1973 | Ebsary | 415/141 |
| 4,027,995 | A | 6/1977 | Berry | |
| 4,284,386 | A * | 8/1981 | Hudson | 415/224 |
| 4,467,217 | A | 8/1984 | Roussey | |
| 4,604,029 | A | 8/1986 | Fink | |

* cited by examiner

*Primary Examiner*—Edward K. Look
*Assistant Examiner*—Richard A Edgar
(74) *Attorney, Agent, or Firm*—Ramon L. Pizarro; Edwin H. Crabtree

(57) ABSTRACT

A turbine engine that includes a housing having a circular cavity of an inlet and an outlet that provide fluid communication to and from the circular cavity. A rotor having a circular body and least one sealing fin extending from the circular body to the cavity wall of the circular cavity. A gas delivered into to the circular cavity causes the fin to move as it expands in the circular cavity. A sealing flap may also be incorporated into the system in order to ensure that gasses are directed against the fin. A valving system for use with the turbine is also disclosed.

15 Claims, 8 Drawing Sheets

ROTARY MOTOR

BACKGROUND OF THE INVENTION (a) Field of the Invention

This invention generally relates to a rotary motor that is driven by fluid flow. More particularly, but not by way of limitation to a motor that includes a rotor that is driven by flowing or expanding fluids.

(b) Discussion of Known Art

Rotary turbine based motors have been known for quite some time. Most turbine based devices use turbine blades that are mounted to a rotor that includes blades that are designed to create a reaction force in response to a flow of fluid. This reaction force is typically a product of lift or transfer of momentum from the moving fluid. Accordingly, well-known turbine based motors require high rates of flow in order to begin to function.

Examples of known turbines include U.S. Pat. No. 1,149,523 to Jerman, Jr., or U.S. Pat. No. 865,164 to Corthesy. The Jerman, Jr. and the Cothesy patent teach the use of rotors with a plurality of fins.

The Jerman, Jr. patent teaches the use of rotors with fins that create pockets of working fluid. The working fluid is delivered to the turbine where it is trapped in pockets, and carried around to the discharge duct of the turbine. This arrangement appears to place little emphasis on the fact that work produced by a device such as turbine is largely due to expansion of the working, pressurized fluid. In other words, the work carried out is expressed by the formula: Work=P·dV, where work is the product of pressure (P) times the change in volume (dV). Accordingly, the capture of the working gas in pockets prevents the change in volume that is required to carry out work.

The reference to Corthesy, uses a rotor with a pair of vanes, and relies on an arrangement that injects and provides for exhaust of gases at about the same location. A significant drawback to this arrangement is that the working fluid delivered through one side of the turbine can place resistance on the working fluid being delivered through the opposite side of the turbine. Furthermore, the need to position the outlet or exhaust next to the inlet results in power losses due to the immediate escape of the working fluid through the exhaust.

Thus, there remains a need for a simple turbine design that allows the effective harness of work through the expansion.

SUMMARY

It has been discovered that the problems left unanswered by known art can be solved by providing a turbine engine comprising:

A housing having a circular cavity of a cavity diameter, the circular cavity being bounded by a cavity wall the housing having an inlet and an outlet that provide fluid communication to and from the circular cavity;

A rotor having a circular body of a rotor diameter; and

At least one sealing fin extending from the circular body to the cavity wall.

According to one example of the invention, the rotor includes a single fin that extends from the circular body of the rotor. Furthermore, it is contemplated that the fin may be made of unitary, one-piece construction with the rotor, and may be made of a resilient material. Thus, the resiliency of the fin urges the fin against the cavity wall, sealing the working fluid between the rotor and the cavity wall.

It is important to note that the principles taught herein may be carried out by providing a rigid fin with a seal between the end of the fin and the cavity wall.

Additionally, it is contemplated that the intake and exhaust will be separated by about fifteen degrees, and more particularly, by about 30 to 45 degrees, but preferably by about 90 degrees.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
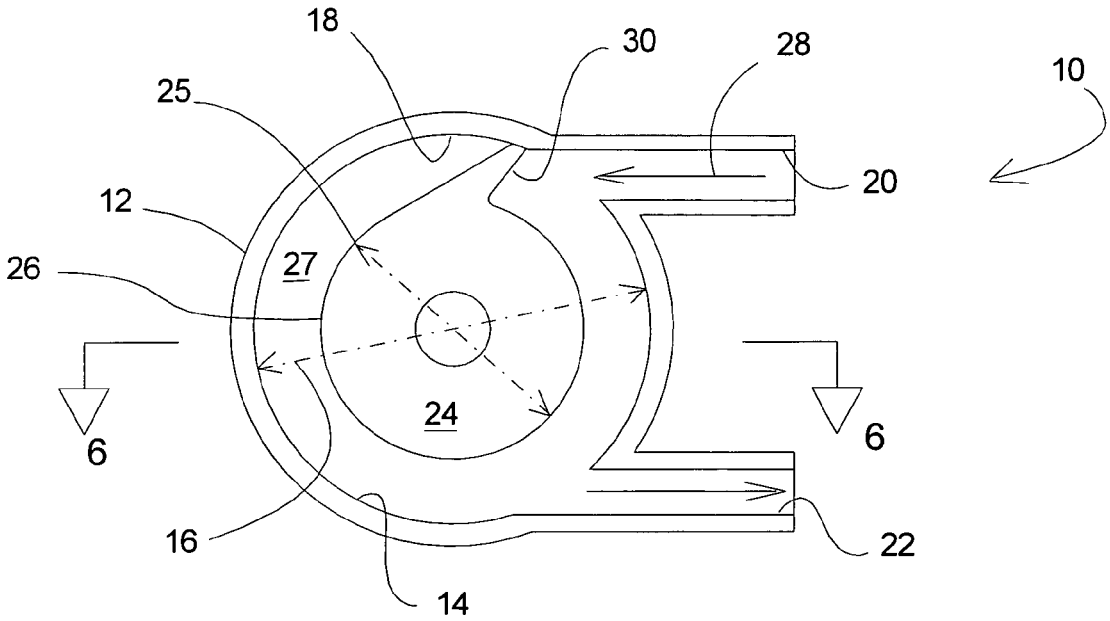
FIG. 1 is a side sectional view of an embodiment of the invention. The view illustrating the use of a single fin rotor.

Turning now to FIG. 1 where a rotary motor 10 incorporating inventive aspects taught herein has been illustrated. As can be understood from the illustration, the motor 10 includes a housing 12 that includes a circular cavity 14 of a cavity diameter 16. The circular cavity 14 is bounded by a cavity wall 18. Additionally, the housing 12 includes an inlet 20 and an outlet 22 that provide fluid communication to and from the circular cavity 14.

A rotor 24 having a circular body 26 is mounted within the circular cavity 14. The circular body 26 is of a rotor diameter 25 that is smaller than the cavity diameter 16. The rotor 24 is positioned within the circular cavity 14 with the rotor being spaced apart in a generally concentric manner with the circular cavity 14 to define an expansion track 27. The expansion track 27 accepts gases 28 introduced into the turbine by way of the inlet 20. The gasses will preferably be introduced at a high flow rate or velocity, and thus provides kinetic energy to be transmitted to the at least one fin 30 that extends from the rotor 24.

As the gasses enter the expansion track 27, and the fin 30 rotates away from the inlet 20, the gas 28 expands allowing the production of work by the engine 10. The fin 30 follows the expansion track 27. As the fin 30 passes the outlet 22, the gas 28 is then allowed to exit the expansion track 27, and then the fin 30 rotates in front of the inlet 20 where it is once again impacted by the gas 28 flow.

Figure 2:
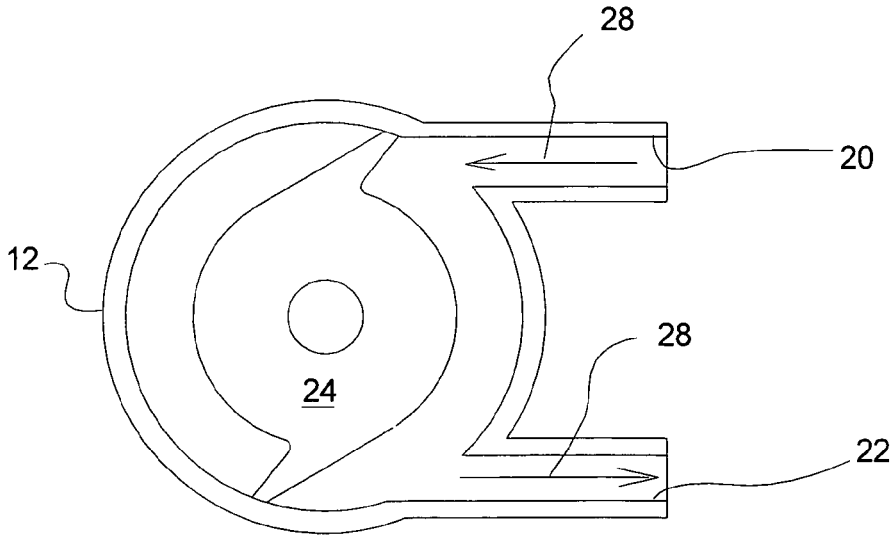
FIG. 2 is a side sectional view of an embodiment of the invention. The view illustrating the use of a double fin rotor.
Figure 3A:
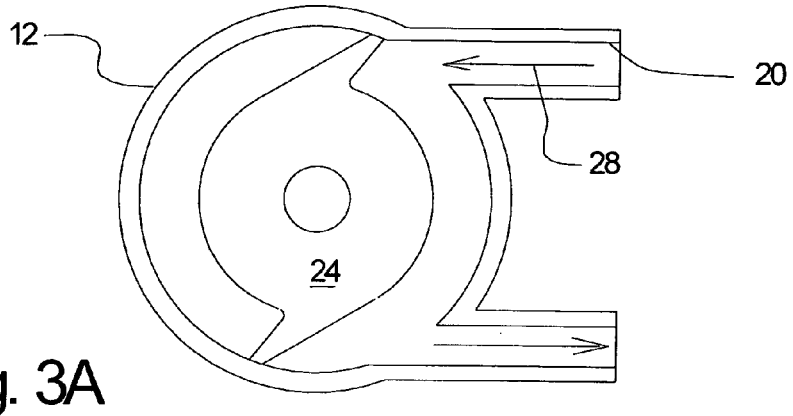
FIG. 3A Illustrates a stage in the operating cycle of the double fin turbine.
Figure 3B:
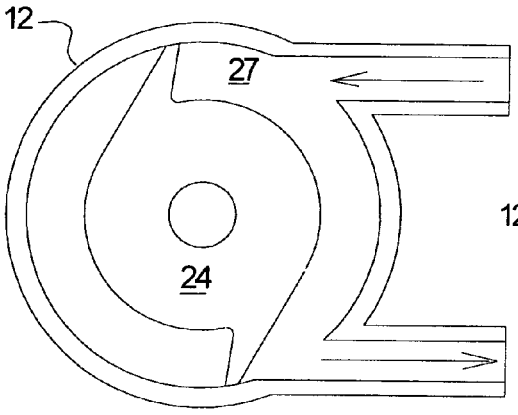
FIG. 3B Illustrates a stage in the operating cycle of the double fin turbine. The stage following the stage illustrated in FIG. 3A.
Figure 3C:
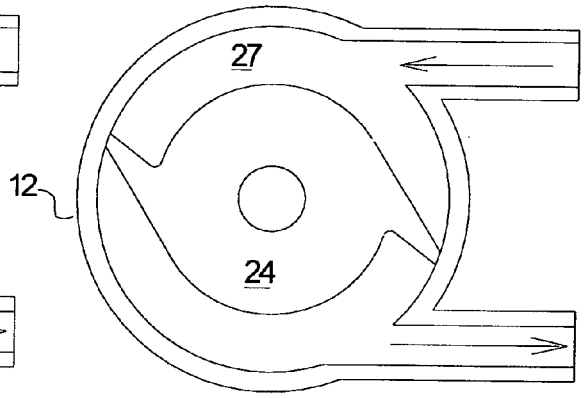
FIG. 3C Illustrates a stage in the operating cycle of the double fin turbine. The stage following the stage illustrated in FIG. 3B.
Figure 3D:
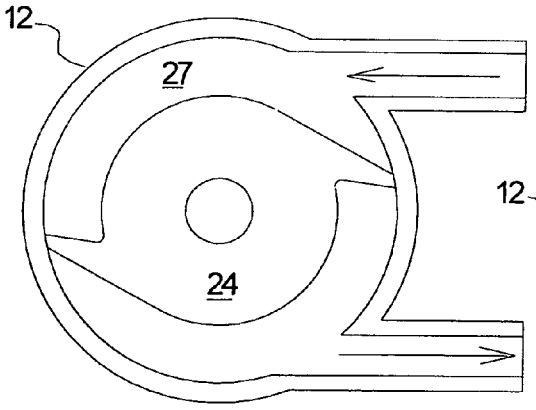
FIG. 3D Illustrates a stage in the operating cycle of the double fin turbine. The stage following the stage illustrated in FIG. 3C.
Figure 3E:
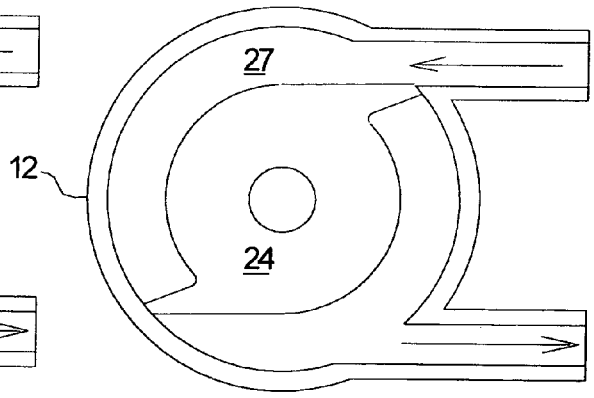
FIG. 3E Illustrates a stage in the operating cycle of the double fin turbine. The stage following the stage illustrated in FIG. 3D.
Figure 4A:
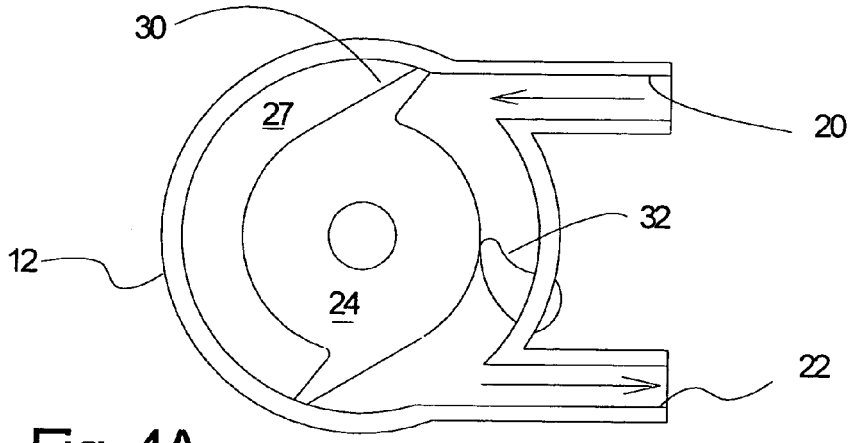
FIG. 4A Illustrates a stage in the operating cycle of the double fin turbine.
Figure 4B:
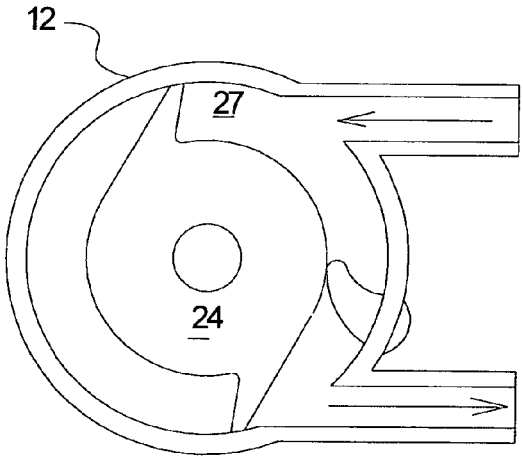
FIG. 4B Illustrates a stage in the operating cycle of the double fin turbine. The stage following the stage illustrated in FIG. 4A.
Figure 4C:
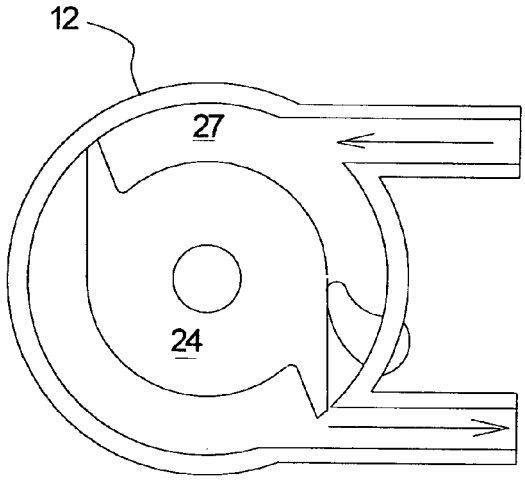
FIG. 4C Illustrates a stage in the operating cycle of the double fin turbine. The stage following the stage illustrated in FIG. 4B.
Figure 4D:
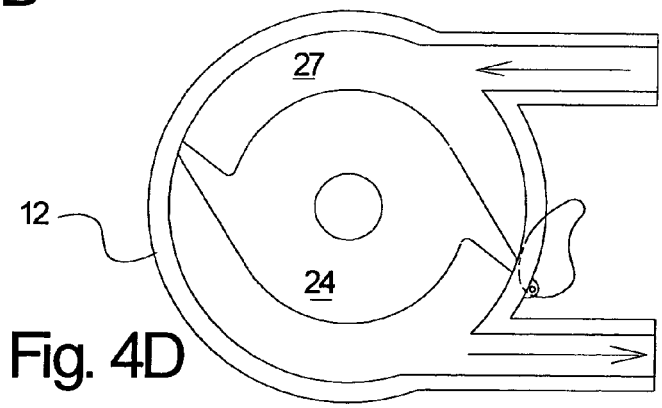
FIG. 4D Illustrates a stage in the operating cycle of the double fin turbine. The stage following the stage illustrated in FIG. 4C.

As illustrated in FIG. 2, at least two sealing fins 30 may also be incorporated into the rotor 24. The sealing fins 30 may be rigid or may be of a flexible or resilient material. Additionally, it is contemplated that the fins 30 may be rigidly or flexibly, pivotably attached to the rotor 24. As illustrated in the enclosed figures, the sealing fins 30 extending from the circular body 26 to the cavity wall 18 to seal the expansion track 27, so that delivery of gas 28 through the inlet 18 allows expansion of the gas in the expansion track 27 and against the sealing fin 30, urging the rotation of the rotor 24.

An example of the rotation sequence has been illustrated in FIGS. 3A–3E, where one complete rotational cycle of a rotor with a pair of sealing fins 30 has been shown. Turning to FIGS. 4A–4E it will be understood that the rotary motor 10 may also include at least one sealing flap 32. The sealing flap 32 extends from the cavity wall 18 towards the rotor 24 and aids in maintaining a pressure differential between the inlet 20 and the outlet 22, and thus maintains a driving force urging the movement of the fins 30 from the inlet 20 towards the outlet 22. As illustrated in FIGS. 4A to 4E, the sealing flap 32 moves away as the fin 30 passes past the outlet 22 and past the sealing flap 32. FIGS. 5A–5E illustrate the use of a sealing flap 32 with a rotor that includes more than one fin 30.

It is important to note that it is contemplated that the single fin configuration illustrated in FIG. 1 will more efficient than the configuration shown in FIGS. 3A–3E because of the larger expansion cycle. It is contemplated that the two fin configuration shown in FIGS. 4A–4E will produce greater average torque output due to the fact that the work done through expansion will be carried out at higher pressures induced by the sealing flap 32.

Figure 5A:
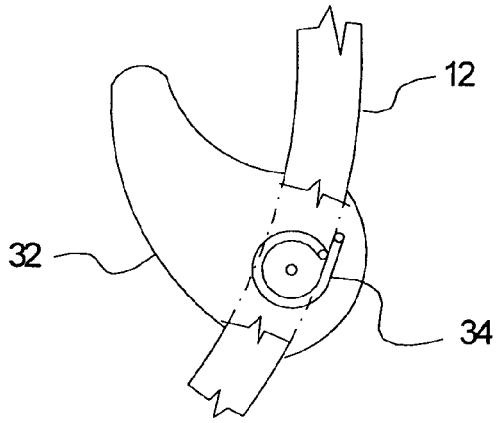
FIG. 5A illustrates an example of a sealing flap that can be used with the disclosed invention.
Figure 5B:
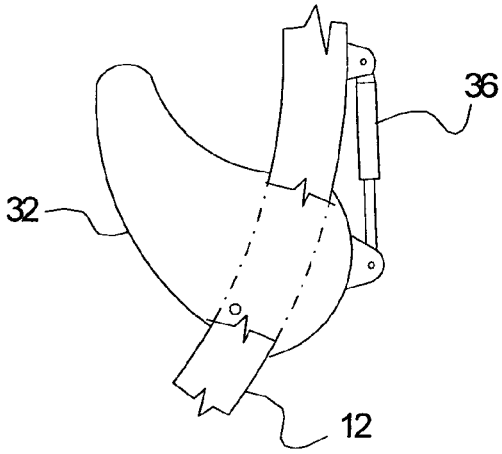
FIG. 5B illustrates another example of a sealing flap that can be used with the disclosed invention.
Figure 5C:
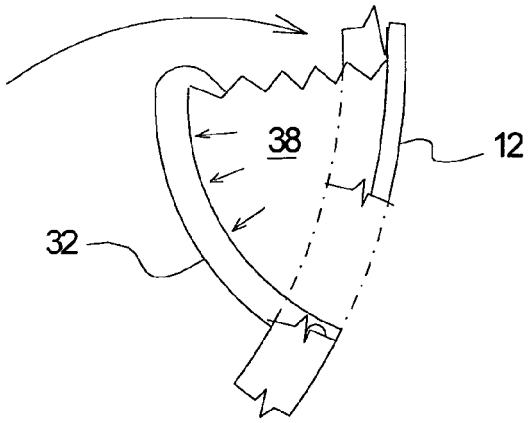
FIG. 5C illustrates another example of a sealing flap that can be used with the disclosed invention.
Figure 5D:
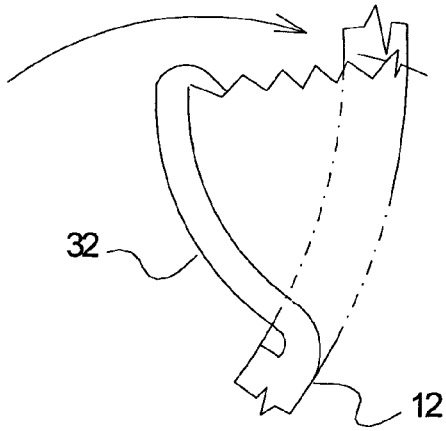
FIG. 5D illustrates yet another example of a sealing flap that can be used with the disclosed invention.

Turning to FIGS. 5A–5D, it will be understood that various sealing flap 32 support arrangements are contemplated. For example, FIG. 5A illustrates that the flap 32 may be pivotably supported from the housing 12. A spring 34 is used to bias the flap 32 towards the rotor 24. Alternatively, as illustrated in FIG. 5B a linear actuator 36 or pressurized telescoping cylinder may also be used to bias the flap 32. FIG. 5C illustrates the use of a pressurized bladder 38 to urge the flap 32 towards the rotor 24. FIG. 5D illustrates the use of resilient integral flap 32.

Figure 6:
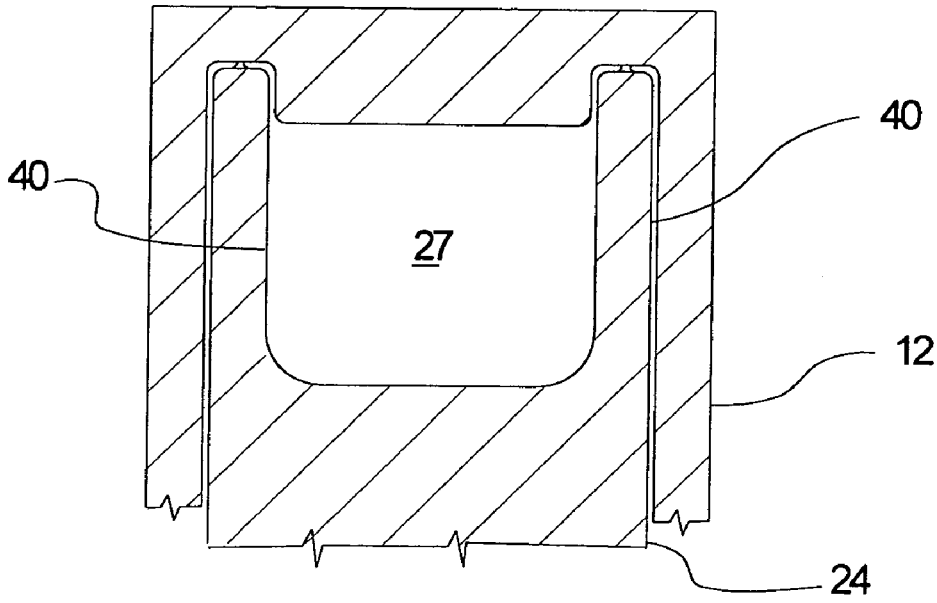
FIG. 6 illustrates the use of a sealing wall with the disclosed invention.

FIG. 6 illustrates the use of a sealing wall 40, which attached to the rotor 24 or the cooperates with the fins 30 and the cavity wall 18 to enhance the sealing of the gases in the expansion track 27.

Figure 7:
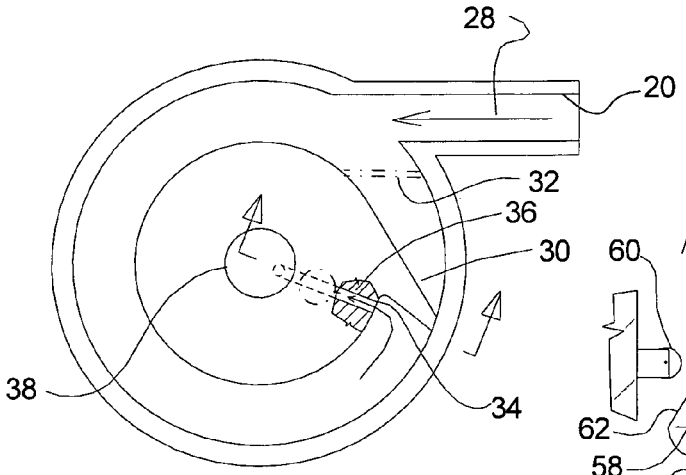
FIG. 7 illustrates an example of the system combined with an exhaust system that allows the exhaust gases to leave through the rotor of the invention.
Figure 8A:
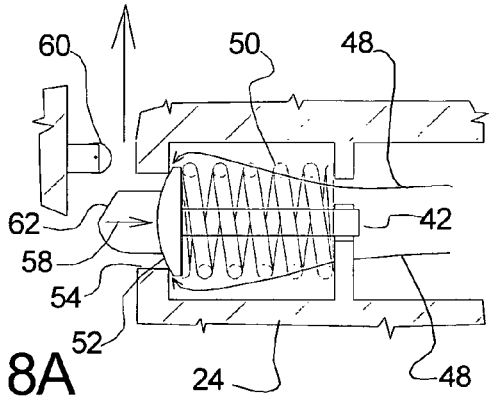
FIG. 8A illustrates an example of a poppet valve system for exhausting gas through the rotor.
Figure 8:
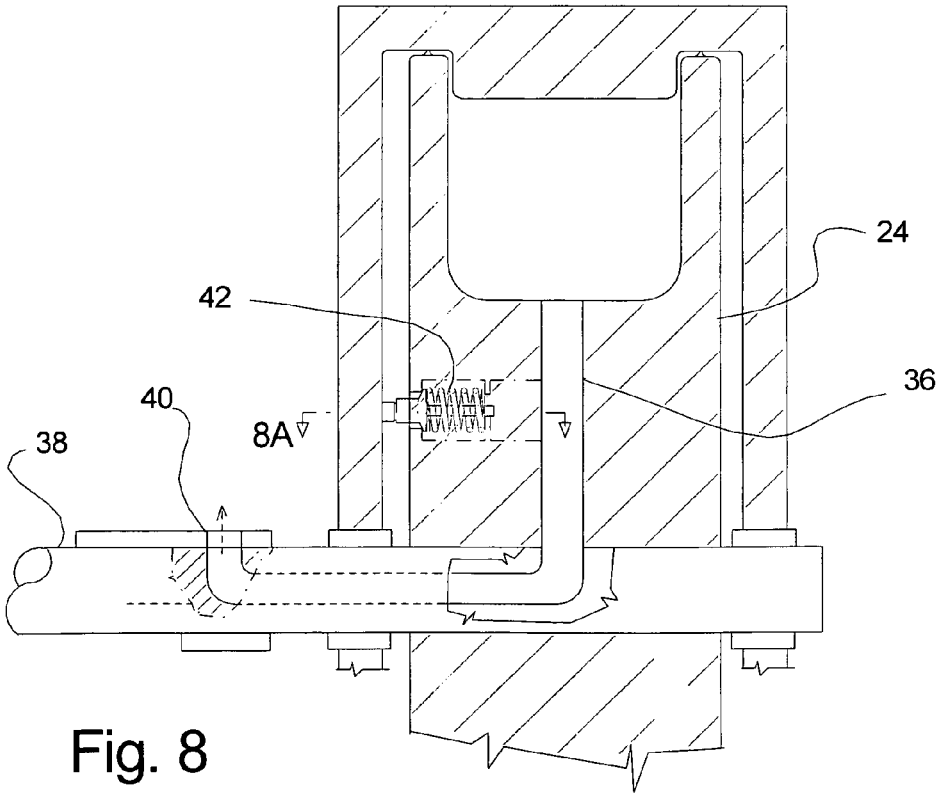
FIG. 8 is a cross-section taken from FIG. 7 along the location indicated on FIG. 7 and illustrates the use of exhaust passages through the shaft or the sides of the rotor as well as the use of an alternative valve system for releasing the exhaust.

Turning now to FIGS. 7 and 8 where an example of an exhaust system that allows the exhaust gases to leave through the rotor has been illustrated. In this example the exhaust gasses pass through a port 34 that extends into the rotor 24. From the rotor 24, the exhaust gasses flow into exhaust ducts 36 in the shaft 38 supporting the rotor 24, where the gasses 28 flow to a set of valves 40 that control the release of the gasses 28 into the atmosphere, a recycling system, or other collection device. It is important to note that it is contemplated that the example illustrated in FIG. 7 can greatly benefit from the use of a sealing flap 32. The sealing flap 32 may be positioned in the location indicated in FIG. 7, and as discussed above, a variety of mechanisms may be used to actuate or bias the sealing flap 32.

FIG. 8 also shows the use of an alternative poppet valve system 42 for releasing the exhaust. This system would obviate the need for using the shaft based exhaust system also illustrated in FIG. 7.

FIG. 8A is a detailed view of the poppet valve system 42 and illustrates the flow paths 48 of the gasses as they exhaust through the rotor 24. In this example, the poppet valve system 42 includes a spring 50 that holds a valve 52 against an exit aperture 54. The valve 52 is moved in the direction of arrow 58 as the roller 60 or other lifter type mechanism urges the cam 62 to move the valve 52 in the direction of the arrow 58.

Figure 9:
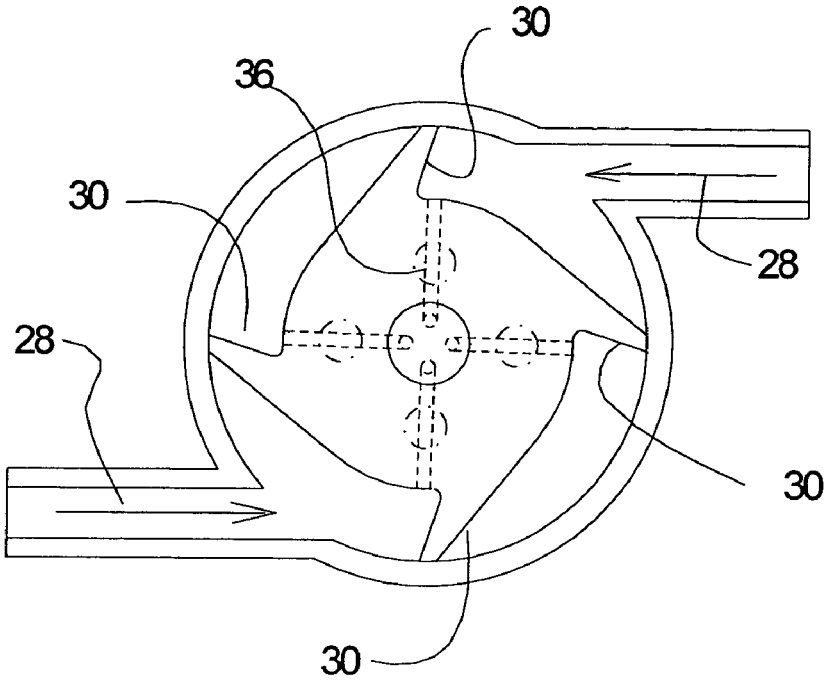
FIG. 9 illustrates an example of the system, which uses four fins and a pair of inlets.

FIG. 9 illustrates an example of the system which uses four fins 30 and a pair of inlets 20. Additionally, the system has been illustrated with the use of the positioning or routing of the shaft based exhaust system or rotor based exhaust system illustrated in FIGS. 8 and 8A. In this example the working fluid or gas 28 is delivered through the inlets 20, resulting a summation of the torque created by the flow from the opposing inlets. The working fluid or gasses are expelled from the motor 10 once the fins 30 have rotated approximately 90 degrees. It is important to note that this example illustrates that the disclosed system allows an increase in the number of fins 30, with corresponding exhaust valving, to increase the amount of torque to be delivered by the motor 10.

Figure 10:
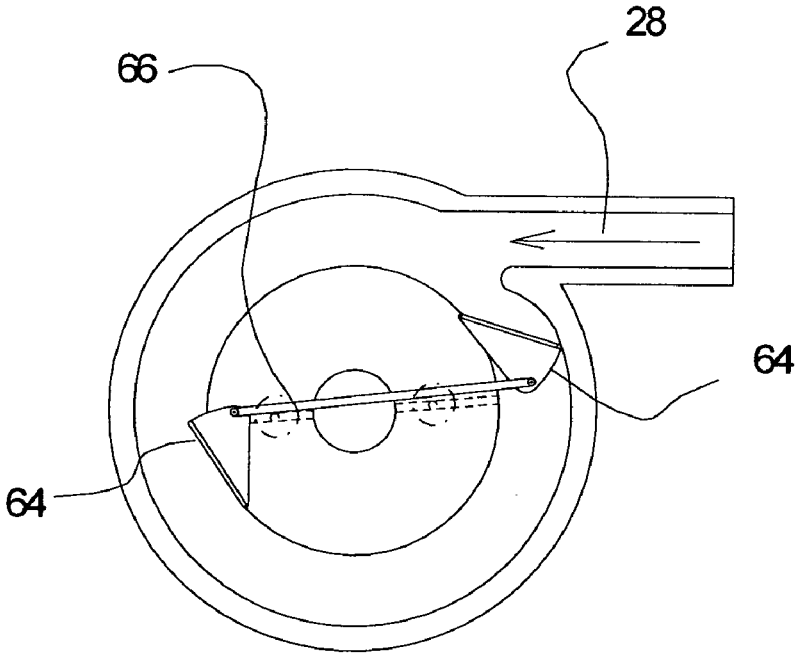
FIG. 10 illustrates an example that uses flexible fins that are connected to one another, causing one fin to be raised when the opposite fin is lowered.

Another example of a fin mechanism has been illustrated in FIG. 10. This figure illustrates the use of flexible or pivoting fins 64. The fins 64 are connected to one another through a link 66 in order to allow one fin to be raised to cooperate with the working fluid or gas, while the opposing fin is lowered and held next to the circular body 26 of the rotor 24. It is important to note that while the example illustrates the use of a rigid link 66, it is also contemplated that other linking mechanisms may also be employed. For example, it is contemplated that a hydraulic connection may be established where fluid displaced due to the lowering of one of the fins causes the opposing fin to rise.

Figure 11:
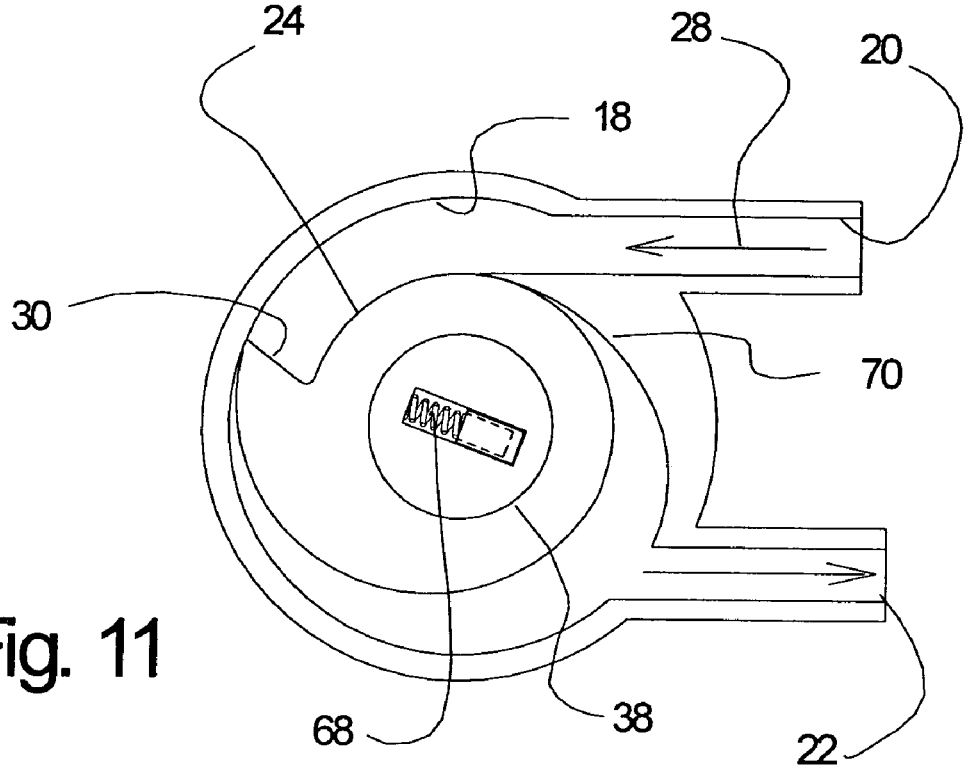
FIG. 11 is yet another example of the system. The example includes a rotor that is movably mounted on the shaft of the invention.
Figure 12:
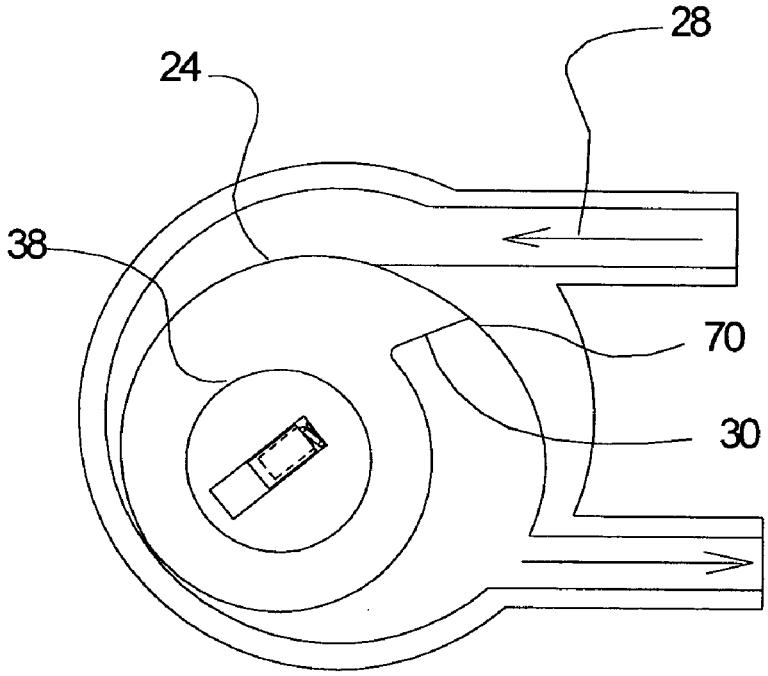
FIG. 12 illustrates the example of FIG. 11 while at the conclusion of the cycle.

Turning now to FIGS. 11 and 12 where yet another example of the disclosed system has been illustrated. In this example includes the rotor 24 has been movably mounted on the shaft 38. A shaft spring 68 maintains the rotor 20 and fin 30 against the cavity wall 18. A sealing lobe 70 extends from the cavity wall 18 and maintains the pressure from the working fluid or gas 28 against the fin 30 during the initial power rotation of the rotor 24. Once a significant amount of expansion is achieved, the fin 30 pass over the outlet 22, concluding the cycle as illustrated in FIG. 12.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A rotary motor comprising:

a housing having a circular cavity of a cavity diameter, the circular cavity being bounded by a cavity wall, and the housing having an inlet and an outlet that provide fluid communication to and from the circular cavity;

a rotor having a circular body, the circular body being of a rotor diameter that is smaller than the cavity diameter, the rotor being positioned within the circular cavity with the rotor being spaced apart and in a generally concentric manner with the circular cavity to define an expansion track; and at least one sealing fin, the sealing fin being attached to the circular body and extending from the circular body to the cavity wall sealing the expansion track, the sealing fin being positioned along the circular body such that there is only one sealing fin between the inlet and the outlet during rotation of the circular body, so that delivery of a pressurized gas through the inlet allows expansion of the gas in the expansion track and against the sealing fin, urging the rotation of the rotor.

2. A rotary motor according to claim 1 and further comprising at least one sealing flap, the sealing flap extending from the cavity wall towards the rotor.

3. A rotary motor according to claim 2 wherein said sealing flap is pivotably supported from the housing.

4. A rotary motor according to claim 1 wherein said sealing fin is made of a resilient material, so that the sealing fin is urged against the cavity wall by the resiliency of the material.

5. A rotary motor according to claim 1 wherein said sealing fin is pivoably connected to the rotor, so that the sealing fin is urged against the cavity wall by centripetal acceleration.

6. A rotary motor comprising:

a housing having a circular cavity of a cavity diameter, the circular cavity being bounded by a cavity wall, and the housing having an inlet that is aligned to deliver a pressurized gas in a generally tangential direction relative to the circular cavity and an outlet that provide fluid communication to and from the circular cavity;

a rotor having a circular body, the circular body being of a rotor diameter that is smaller than the cavity diameter, the rotor being positioned within the circular cavity with the rotor being spaced apart and in a generally concentric manner with the circular cavity to define an expansion track; and at least two sealing fins, the sealing fins being attached to the circular body and extending from the circular body to the cavity wall to seal the expansion track, the sealing fins being positioned along the circular body such that there is at most one sealing fin between the inlet and the outlet during rotation of the circular body, so that delivery of the pressurized gas through the inlet allows expansion of the gas in the expansion track and against the sealing fin, urging the rotation of the rotor.

7. A rotary motor according to claim 6 and further comprising at least one sealing flap, the sealing flap extending from the cavity wall towards the rotor.

8. A rotary motor according to claim 7 wherein said sealing flap is pivotably supported from the housing.

9. A rotary motor according to claim 6 wherein said sealing fins are made of a resilient material, so that each of the sealing fins is urged against the cavity wall by the resiliency of the material.

10. A rotary motor according to claim 6 wherein each of said sealings fin is pivoably connected to the rotor, so that each of the sealing fins is urged against the cavity wall by centripetal acceleration.

11. A rotary motor comprising:

a housing having a circular cavity of a cavity diameter, the circular cavity being bounded by a cavity wall, and the housing having an inlet that is aligned to deliver a pressurized gas in a generally tangential direction relative to the circular cavity, and an outlet that provide fluid communication from the circular cavity;

a rotor having a circular body, the circular body being of a rotor diameter that is smaller than the cavity diameter, the rotor being positioned within the circular cavity with the rotor being spaced apart and in a generally concentric manner with the circular cavity to define an expansion track; and at least two sealing fins, the sealing fins being attached to the circular body and extending from the circular body to the cavity wall, the sealing fins being positioned along the circular body such that there is at most one sealing fin between the inlet and the outlet during rotation of the circular body;

a pair of sealing walls, the sealing walls extending from the rotor to the cavity wall, the sealing walls cooperating with the sealing fins to seal the expansion track, so that delivery of a pressurized gas through the inlet allows expansion of the gas in the expansion track and against the sealing fin, urging the rotation of the rotor.

12. A rotary motor according to claim 11 and further comprising at least one sealing flap, the sealing flap extending from the cavity wall towards the rotor.

13. A rotary motor according to claim 12 wherein said sealing flap is pivotably supported from the housing.

14. A rotary motor according to claim 11 wherein said sealing fins are made of a resilient material, so that each of the sealing fins is urged against the cavity wall by the resiliency of the material.

15. A rotary motor according to claim 11 wherein each of said sealing fins is pivoably connected to the rotor, so that each of the sealing fins is urged against the cavity wall by centripetal acceleration.

* * * * *